US010714866B2

(12) United States Patent
Zhou

(10) Patent No.: US 10,714,866 B2
(45) Date of Patent: Jul. 14, 2020

(54) ELECTRICAL CONNECTOR ASSEMBLY WITH PROTECTIVE GUIDING OUTER HOUSING

(71) Applicants: FUYU ELECTRONICAL TECHNOLOGY (HUAIAN) CO., LTD., Huai'an (CN); FOXCONN INTERCONNECT TECHNOLOGY LIMITED, Grand Cayman (KY)

(72) Inventor: Shao-Cong Zhou, Huaian (CN)

(73) Assignees: FUYU ELECTRONICAL TECHNOLOGY (HUAIAN) CO., Huai'an (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 10 days.

(21) Appl. No.: 16/248,796

(22) Filed: Jan. 16, 2019

(65) Prior Publication Data

US 2019/0229459 A1 Jul. 25, 2019

(30) Foreign Application Priority Data

Jan. 23, 2018 (CN) ..... 2018 2 0113609 U

(51) Int. Cl.

| | |
|---|---|
| ***H01R 13/516*** | (2006.01) |
| ***H01R 13/52*** | (2006.01) |
| ***H01R 13/6585*** | (2011.01) |
| ***H01R 12/70*** | (2011.01) |
| ***H01R 13/506*** | (2006.01) |
| ***H01R 13/6594*** | (2011.01) |
| ***H01R 12/71*** | (2011.01) |
| *H01R 13/627* | (2006.01) |
| *H01R 24/60* | (2011.01) |

(52) U.S. Cl.

CPC ..... *H01R 13/516* (2013.01); *H01R 12/7023* (2013.01); *H01R 12/716* (2013.01); *H01R 13/506* (2013.01); *H01R 13/5202* (2013.01); *H01R 13/6585* (2013.01); *H01R 13/6594* (2013.01); *H01R 12/7052* (2013.01); *H01R 12/712* (2013.01); *H01R 13/627* (2013.01); *H01R 24/60* (2013.01)

(58) Field of Classification Search

CPC ..... H01R 13/5202; H01R 13/516
See application file for complete search history.

(56) References Cited

U.S. PATENT DOCUMENTS

| | | | | |
|---|---|---|---|---|
| 7,232,344 | B1 | 6/2007 | Hon | |
| 2014/0106597 | A1* | 4/2014 | Gimbel | H01R 13/4223 439/345 |
| 2014/0295689 | A1* | 10/2014 | Zhao | H01R 12/724 439/271 |

(Continued)

*Primary Examiner* — James Harvey
(74) *Attorney, Agent, or Firm* — Wei Te Chung; Ming Chieh Chang

(57) ABSTRACT

An electrical connector assembly includes: an electrical connector including a terminal module, a shielding shell enclosing the terminal module, an insulative cover enclosing the shielding shell, and a sealing member disposed at a front portion of the insulative cover; and an outer housing accommodating the electrical connector, wherein the insulative cover has a plurality of humps engaging an inner surface of the outer housing, and the sealing member is compressed between the front portion of the insulative cover and the inner surface of the outer housing.

19 Claims, 15 Drawing Sheets

(56) References Cited

U.S. PATENT DOCUMENTS

| | | | | |
|---|---|---|---|---|
| 2014/0315439 | A1* | 10/2014 | Zhang | H01R 13/516 439/626 |
| 2015/0229077 | A1 | 8/2015 | Little et al. | |
| 2015/0325944 | A1* | 11/2015 | Chien | H01R 13/5202 439/271 |
| 2017/0110812 | A1* | 4/2017 | Tsai | H01R 12/57 |
| 2017/0155219 | A1* | 6/2017 | Wali | H01R 13/625 |
| 2017/0229823 | A1* | 8/2017 | Tsai | H01R 24/60 |
| 2017/0256881 | A1 | 9/2017 | Lambie et al. | |
| 2017/0324188 | A1* | 11/2017 | Guo | H01R 13/405 |
| 2017/0373440 | A1* | 12/2017 | Zhao | H01R 12/58 |
| 2019/0067872 | A1* | 2/2019 | Cha | H01R 13/5202 |
| 2019/0173221 | A1* | 6/2019 | de Chazal | H01R 13/4368 |
| 2019/0199038 | A1* | 6/2019 | Zhou | H01R 13/6587 |
| 2019/0229459 | A1* | 7/2019 | Zhou | H01R 12/7023 |

* cited by examiner

ELECTRICAL CONNECTOR ASSEMBLY WITH PROTECTIVE GUIDING OUTER HOUSING

BACKGROUND OF THE INVENTION

1. Field of the Invention

The present invention relates generally to an electrical connector assembly including an electrical connector of a vertical or straight type and an outer housing accommodating the electrical connector, wherein the electrical connector has a front sealing member and an insulative cover designed to obtain an interference fit with an inner surface of the outer housing at a desired force.

2. Description of Related Art

U.S. Patent Application Publication No. 2015/0229077 depicts a vertical receptacle connector for mounting to a printed circuit board in an upstanding manner. U.S. Patent Application Publication No. 2017/0256881 discloses a USB type connector that may be a vertical/straight version connector or a right angle version connector. In the vertical embodiment, contact tails extend straight out of a rear of the connector. As a result, a printed circuit board to which the connector is mounted is parallel to a panel that the connector is associated.

On the other hand, in certain applications, it is preferable that an outer housing accommodates an electrical connector to provide added stability to the connector during its mating with an inserted mating connector.

SUMMARY OF THE INVENTION

An electrical connector assembly comprises: an electrical connector including a terminal module, a shielding shell enclosing the terminal module, an insulative cover enclosing the shielding shell, and a sealing member disposed at a front portion of the insulative cover; and an outer housing accommodating the electrical connector, wherein the insulative cover has a plurality of humps engaging an inner surface of the outer housing, and the sealing member is compressed between the front portion of the insulative cover and the inner surface of the outer housing.

DETAILED DESCRIPTION OF THE PREFERRED EMBODIMENT

Figure 1:
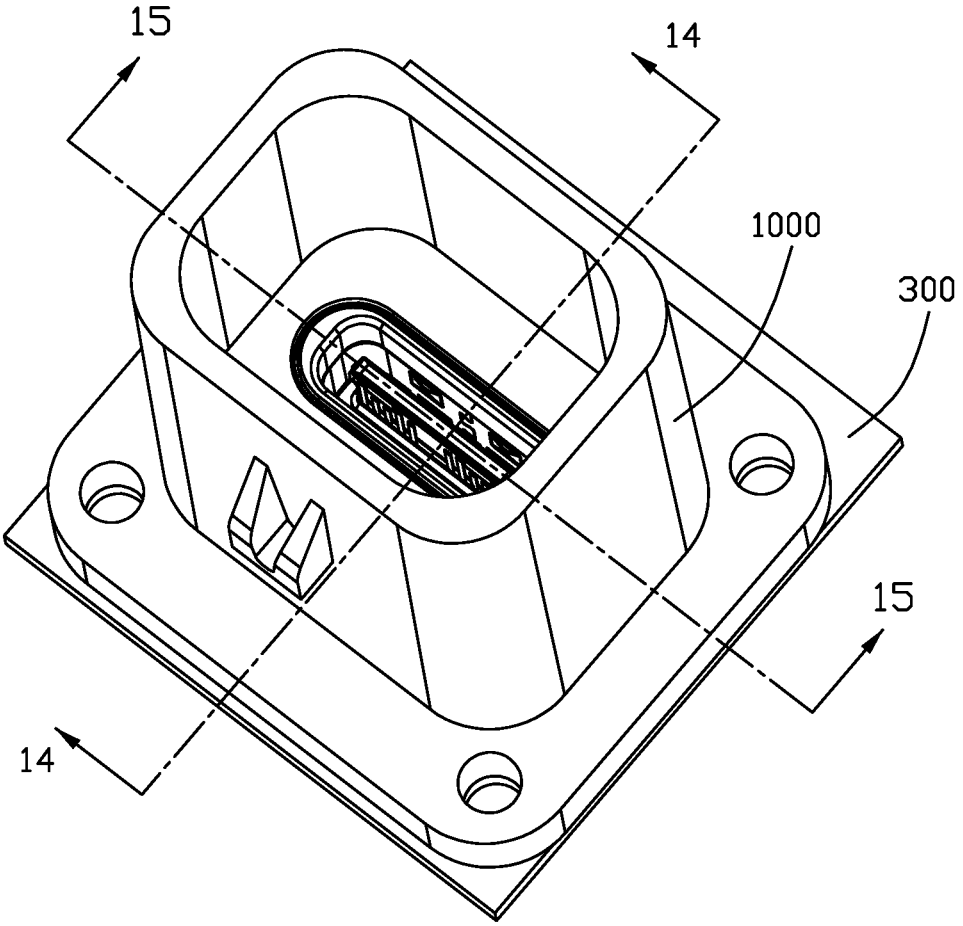
FIG. 1 is a perspective view of an electrical connector assembly in accordance with the present invention mounted to a printed circuit board.
Figure 2:
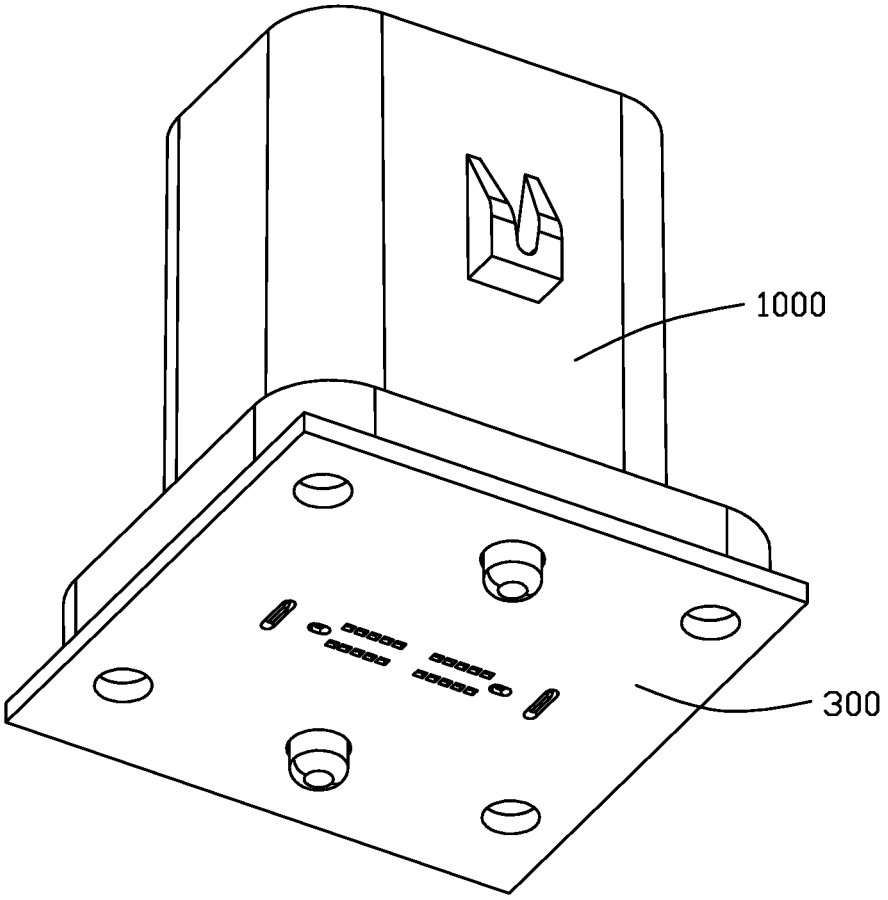
FIG. 2 is another perspective view of the electrical connector assembly.
Figure 3:
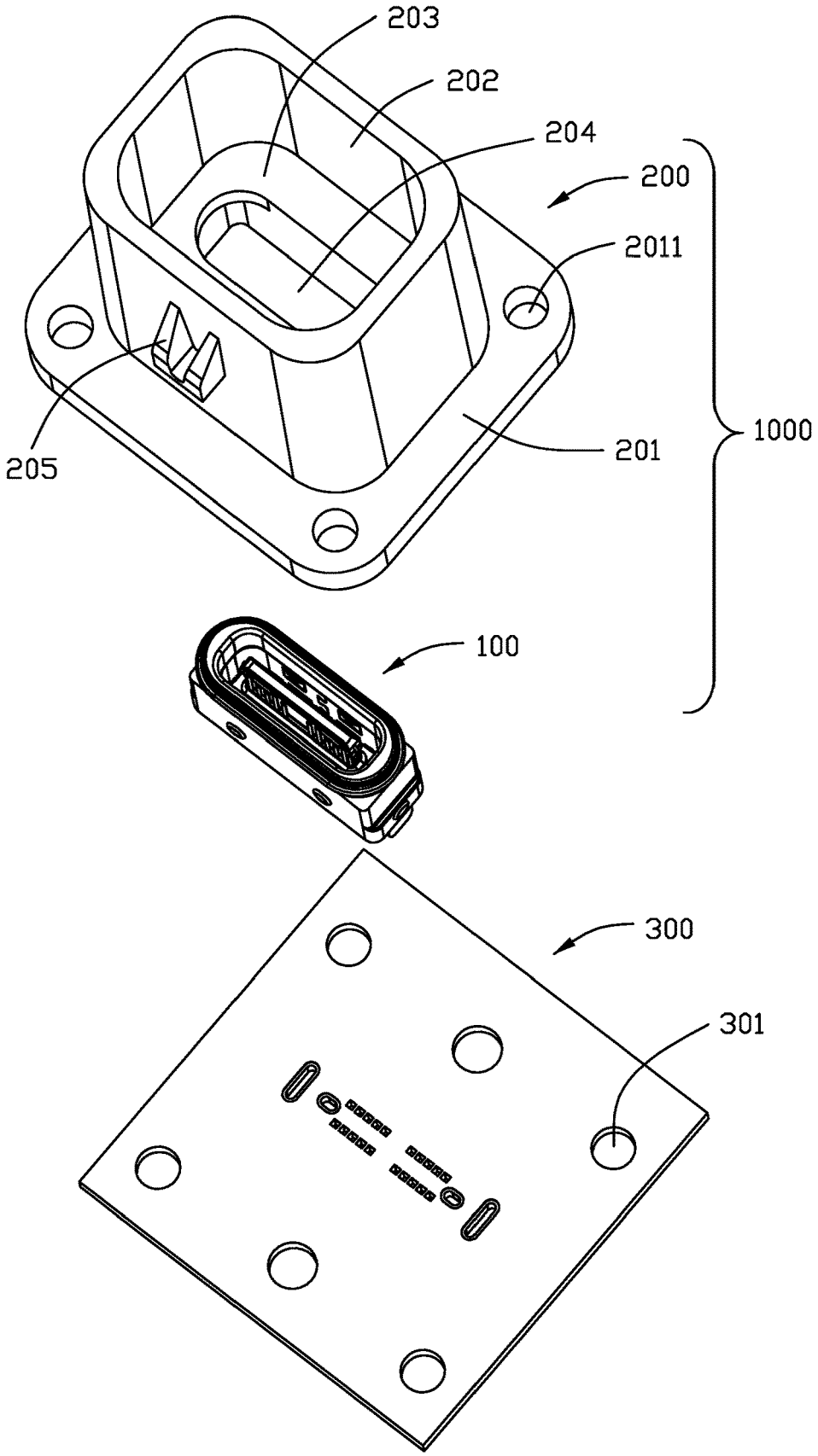
FIG. 3 is an exploded view of the electrical connector assembly.
Figure 4:
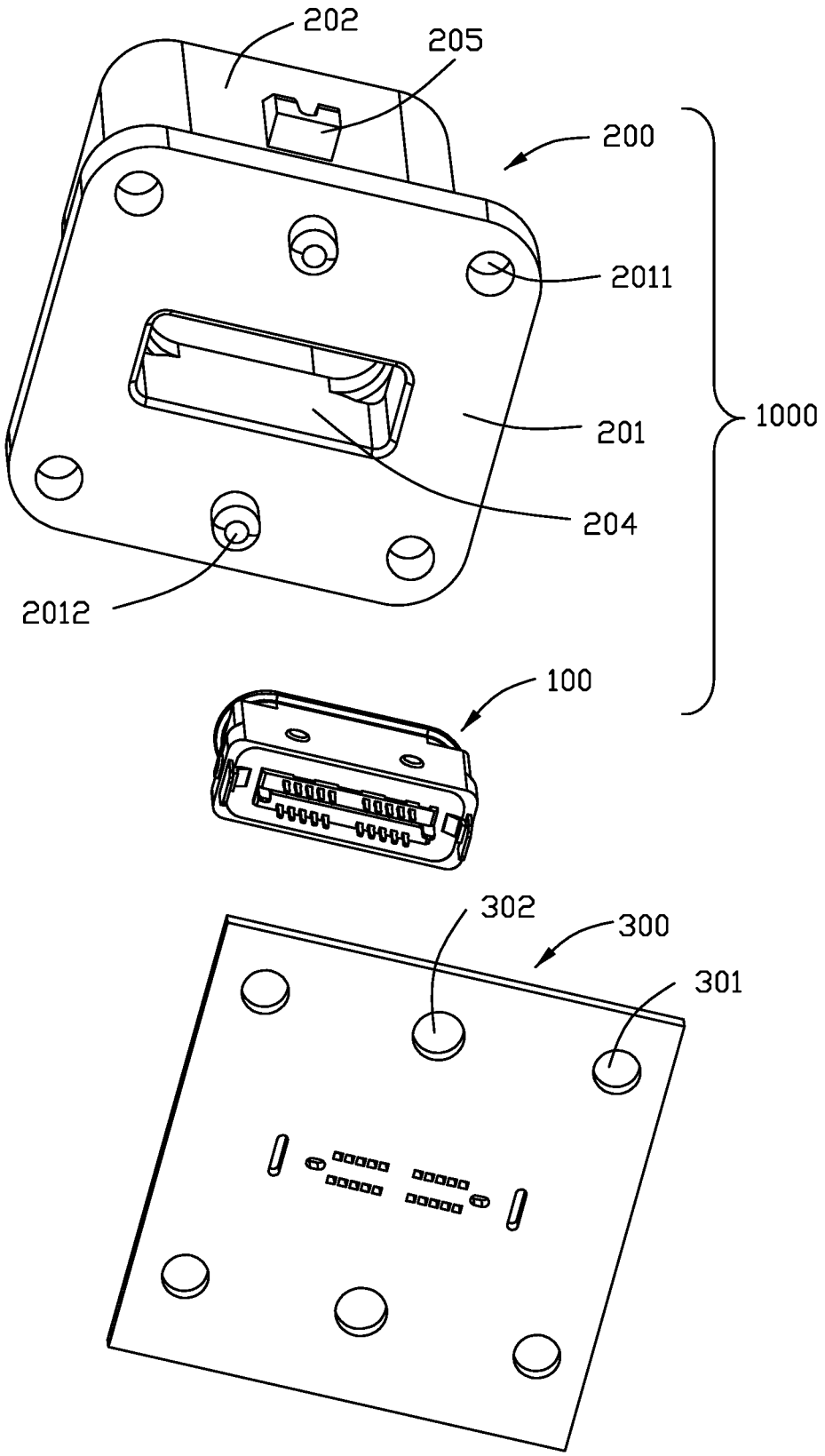
FIG. 4 is another exploded view of the electrical connector assembly.
Figure 5:
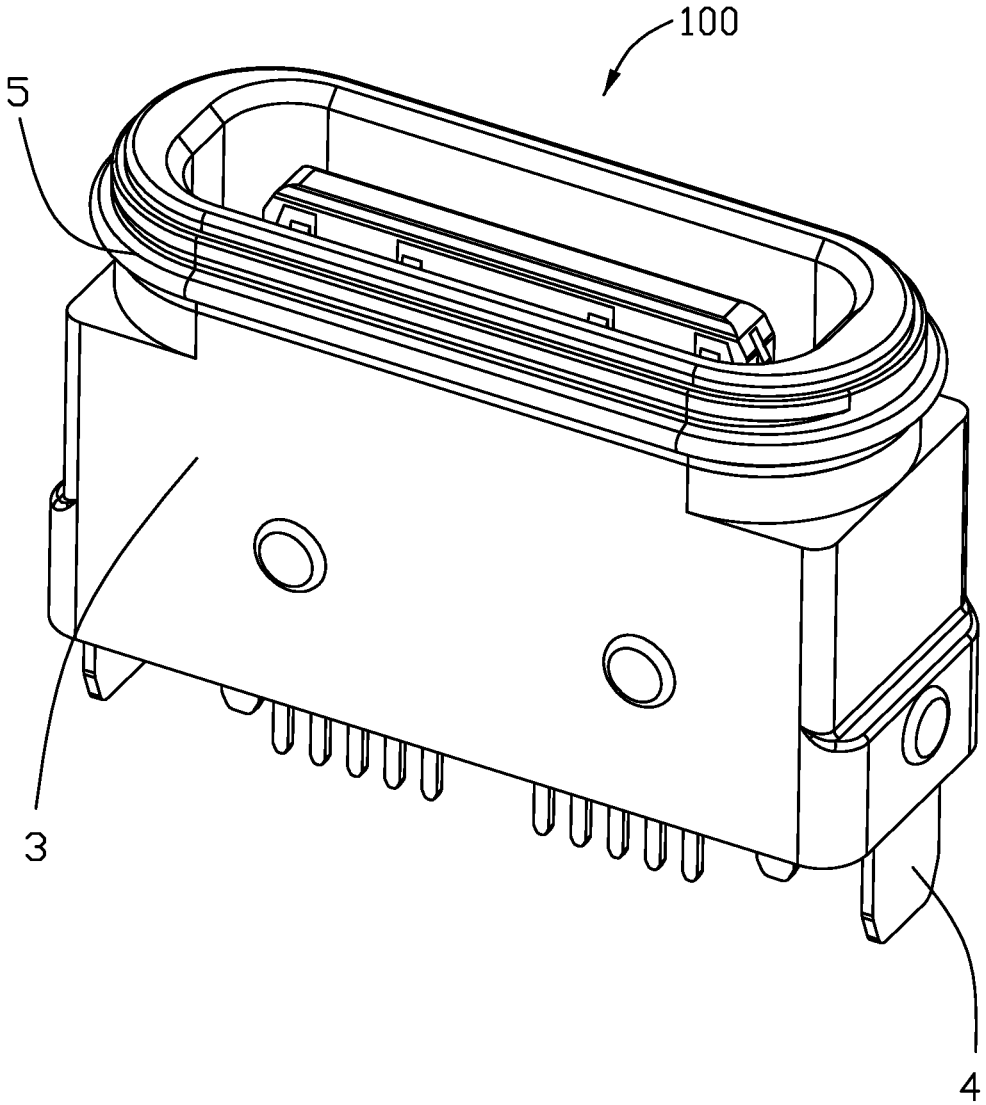
FIG. 5 is a perspective view of an electrical connector of the electrical connector assembly.
Figure 6:
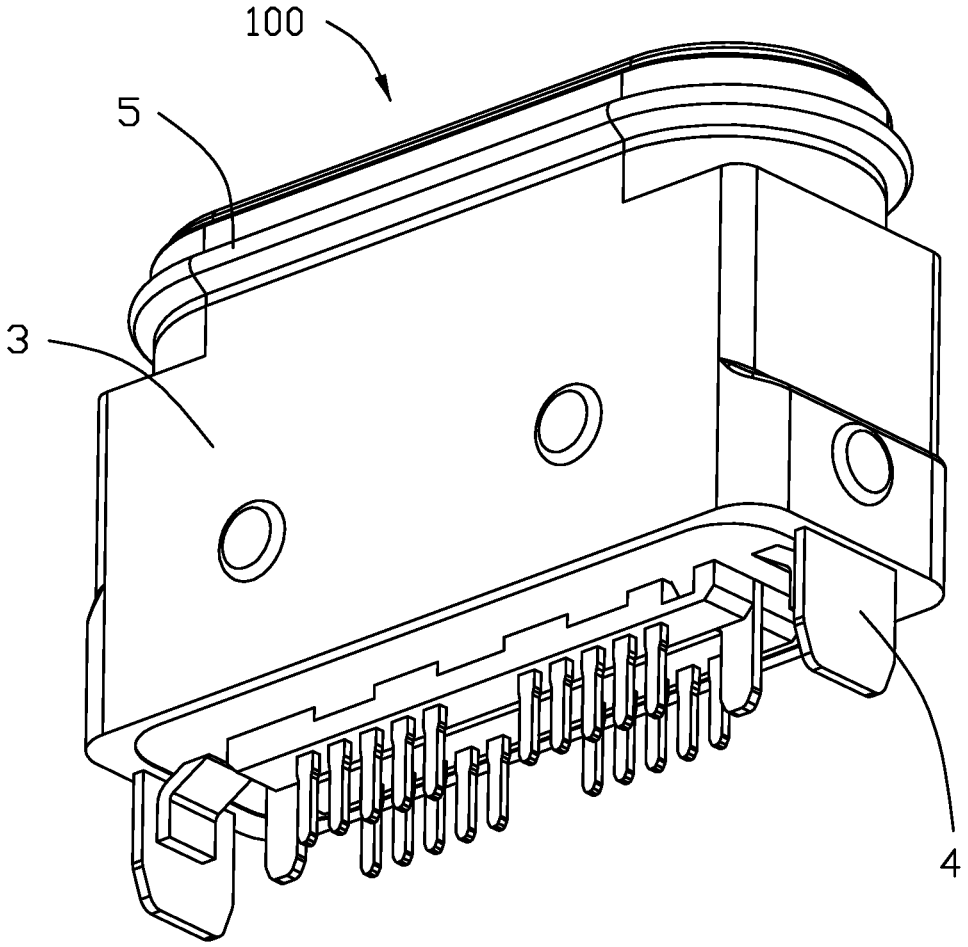
FIG. 6 is another perspective view of the electrical connector.

Referring to FIGS. 1-4, an electrical connector assembly 1000 is to be mounted on a printed circuit board (PCB) 300. The electrical connector assembly 1000 includes an electrical connector 100 and an outer housing 200 accommodating the electrical connector 100.

Referring to FIGS. 5-13, the electrical connector 100 includes a terminal module 1, a shielding shell 2 enclosing the terminal module 1, an insulative cover 3 enclosing the shielding shell 2, and a front sealing member 5. The electrical connector 100 may further include a rear sealing member 6 and the insulative cover 3 may be equipped with a pair of stands 4.

Referring to FIGS. 7-13, the terminal module 1 includes a first unit 11, a second unit 12, a shielding plate 13 between the first unit 11 and the second unit 12, and an over-molding insulator 14 molded to the first unit 11, the second unit 12, and the shielding plate 13. The first unit 11 has a first insulative body 111 and a first row of contacts 112 secured to (e.g., insert molded with) the insulative body 111. The second unit 12 has a second insulative body 121 and a second row of contacts 122 secured to (e.g., insert molded with) the insulative body 121.

The insulative body 111 and the insulative body 121 have same structure. The insulative body 111 and the insulative body 121 have respective mounting surfaces 1111 and 1211 facing each other. Each insulative body 111 or 121 has a rear base 113, a front tongue 114, and an intermediate step 115. The step 115 has a groove 1151. The base 113 has a hook 1131 and a hole 1132 on the mounting surface side.

The first row of contacts 112 and the second row of contacts 122 are equal in number and reversely-symmetrically arranged to support dual orientation mating, as is well known in this art.

The first row of contacts 112 and the second row of contacts 122 have same structure. Each contact includes a securing potion 1121, a contacting portion 1122, and a soldering portion 1123. Each row of contacts include a pair of outermost ground contacts 1124. One of the pair of outermost ground contacts 1124 has a bent portion 1125.

The shielding plate 13 has a main portion 131, a pair of front portions 132, and a pair of soldering legs 133. The main portion 131 has a pair of holes 1311.

Since the insulative body 111 and the insulative body 121 have same structure and the first row of contacts 112 and the second row of contacts 122 have same structure, only one same set of molds is needed for manufacturing the first unit 11 and the second unit 12 which are of same structure.

The shielding plate 13 is clamped between the first unit 11 and the second unit 12 through the hook 1131 and hole 1132 structure and cooperating holes 1311 feature. Also the bent portion 1125 of the ground contact 1124 of one unit is received in the groove 1151 of the other unit. With securement of the first unit 11, the second unit 12, and the shielding plate 13, the over-molding insulator 14 is then molded.

Figure 7:
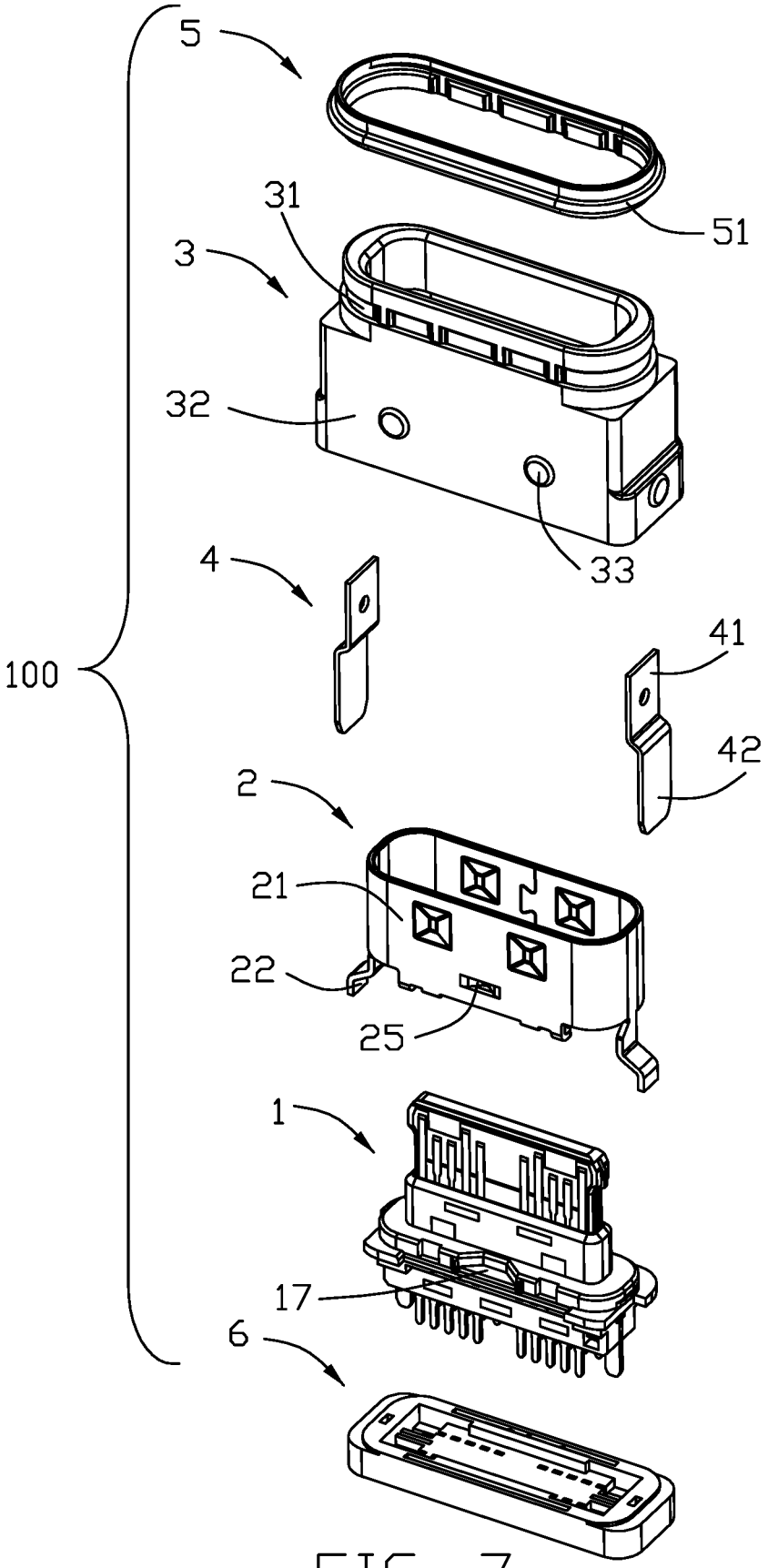
FIG. 7 is an exploded view of the electrical connector.
Figure 8:
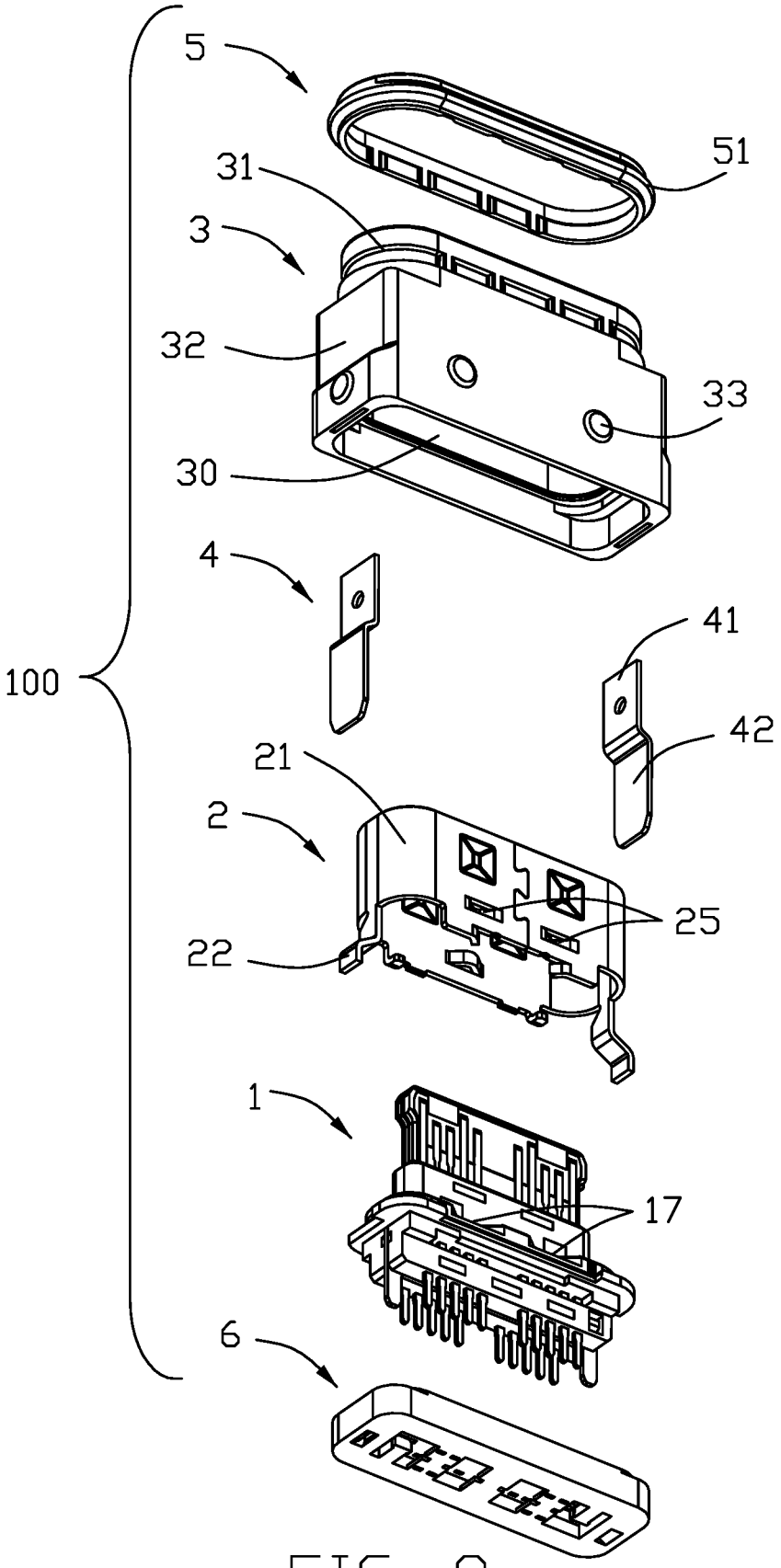
FIG. 8 is another exploded view of the electrical connector.
Figure 9:
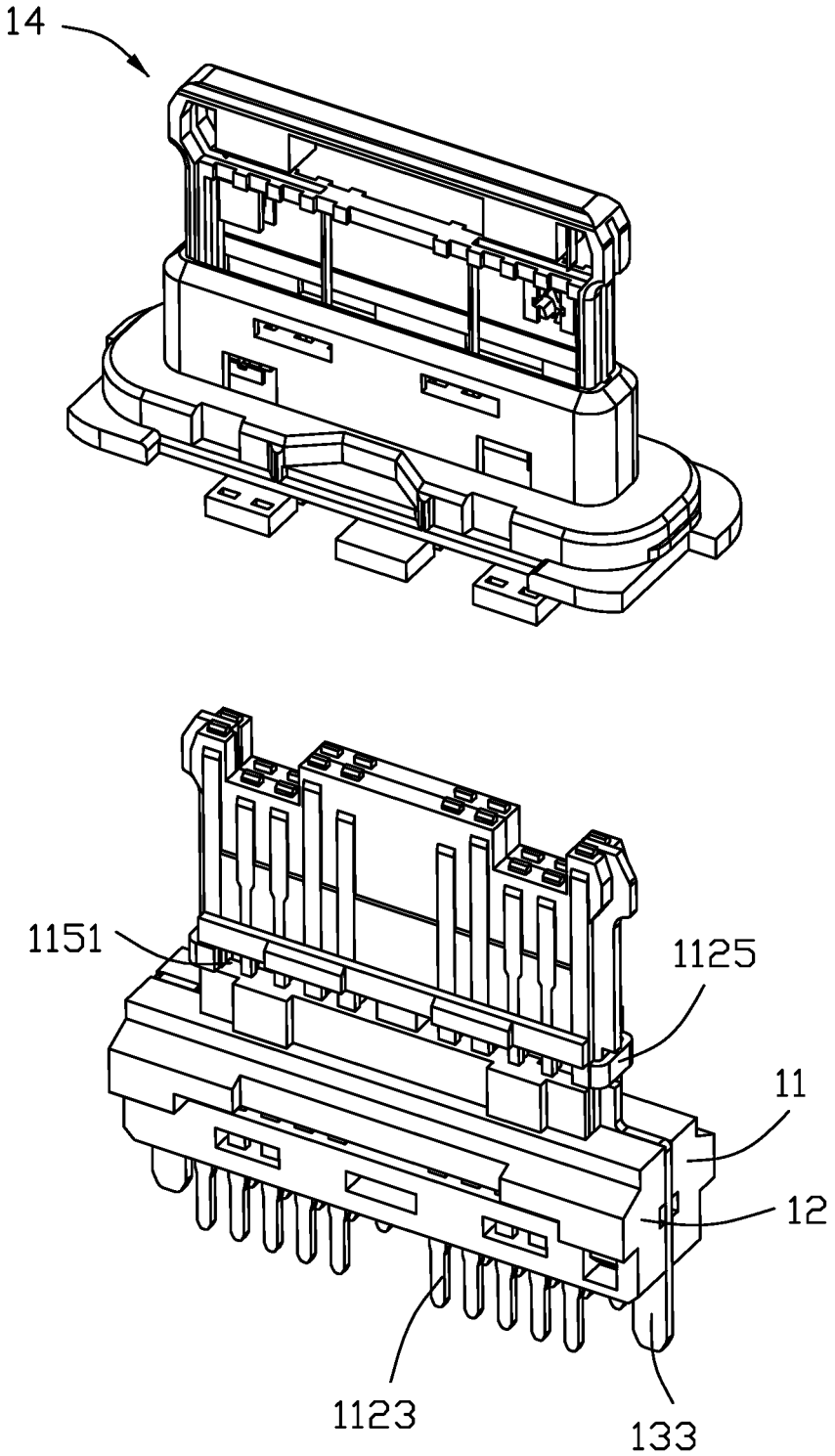
FIG. 9 is an exploded view of a terminal module of the electrical connector.
Figure 10:
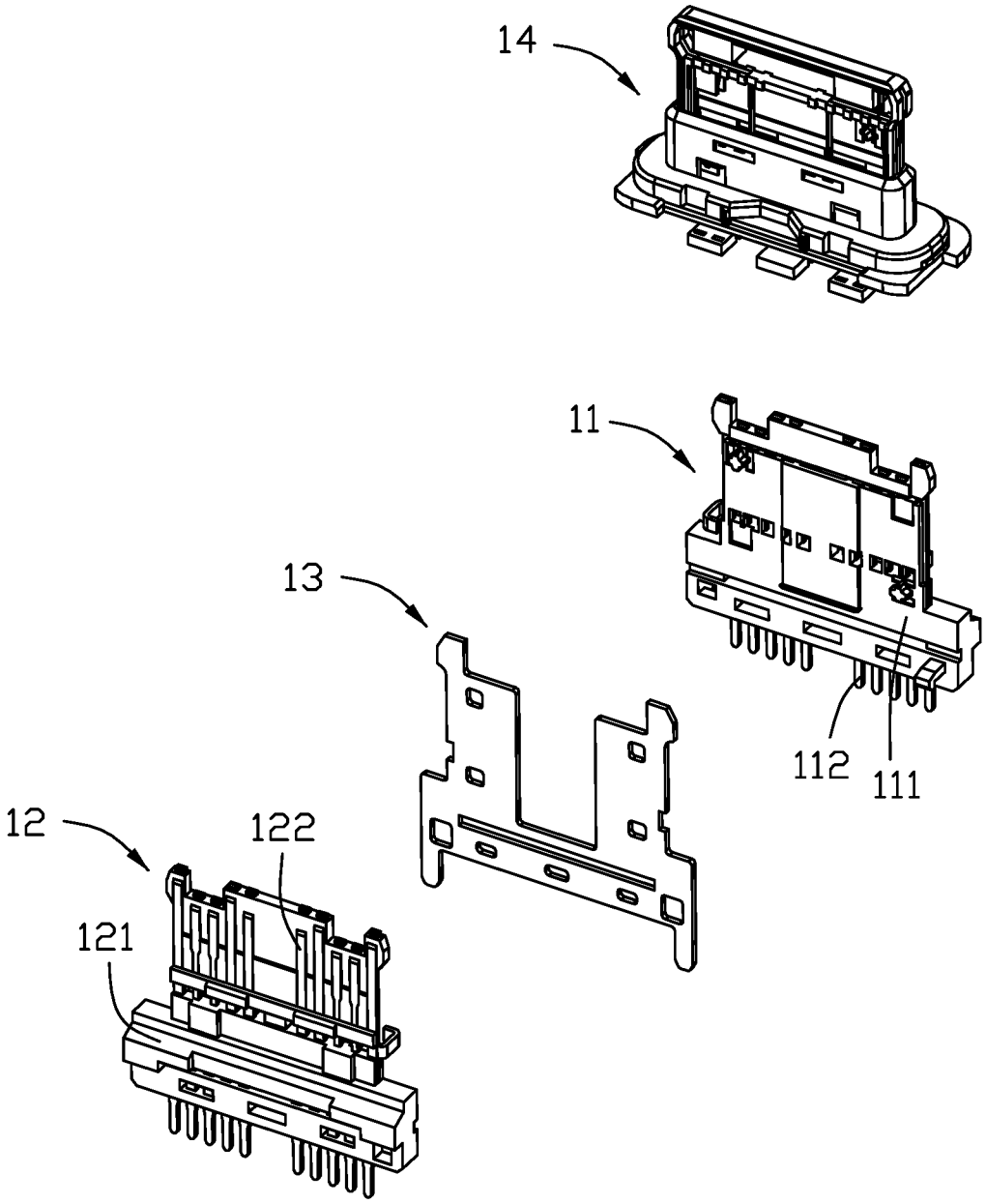
FIG. 10 is a further exploded view of the terminal module.
Figure 11:
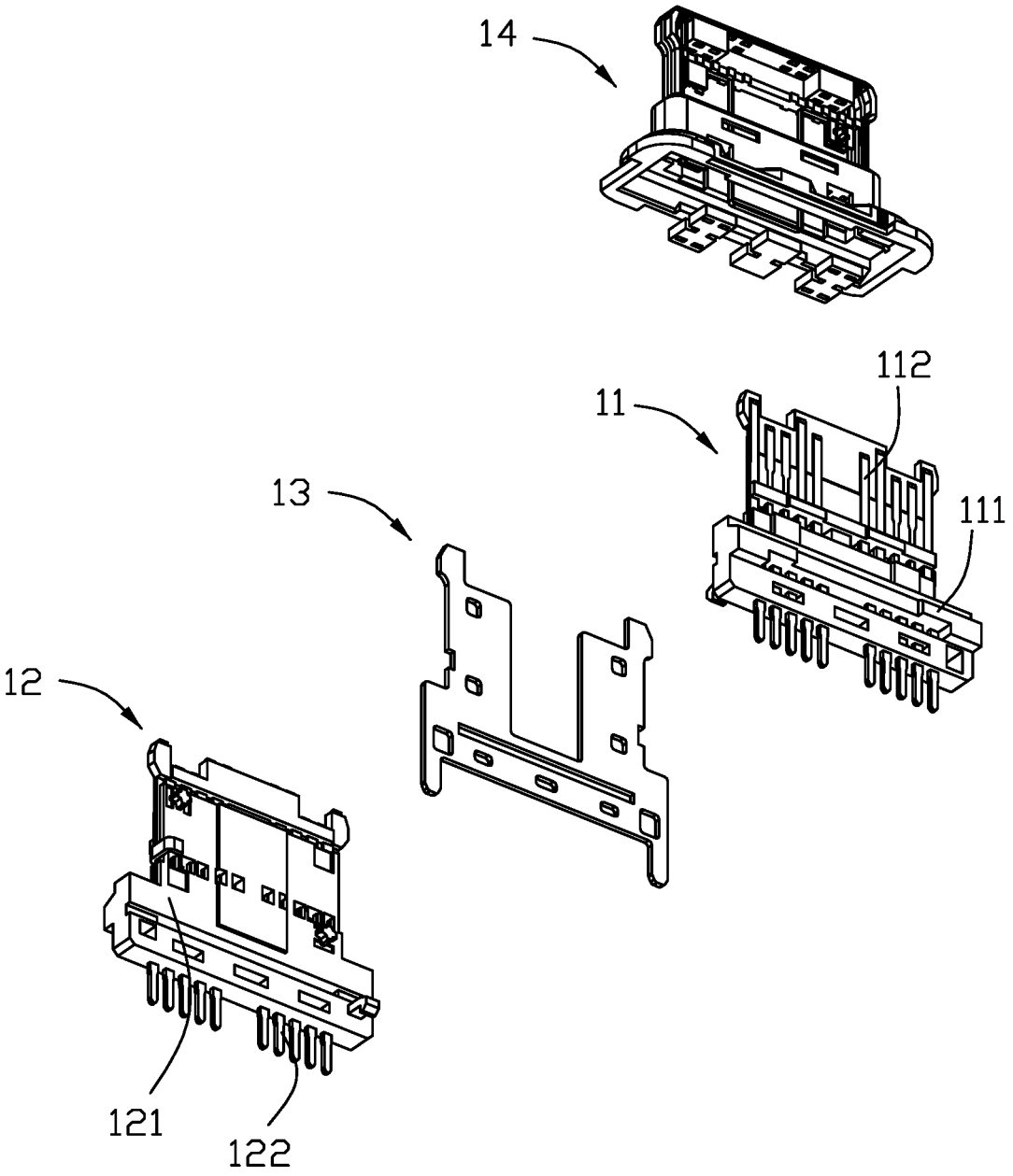
FIG. 11 is a view similar to FIG. 10 but from another perspective.
Figure 12:
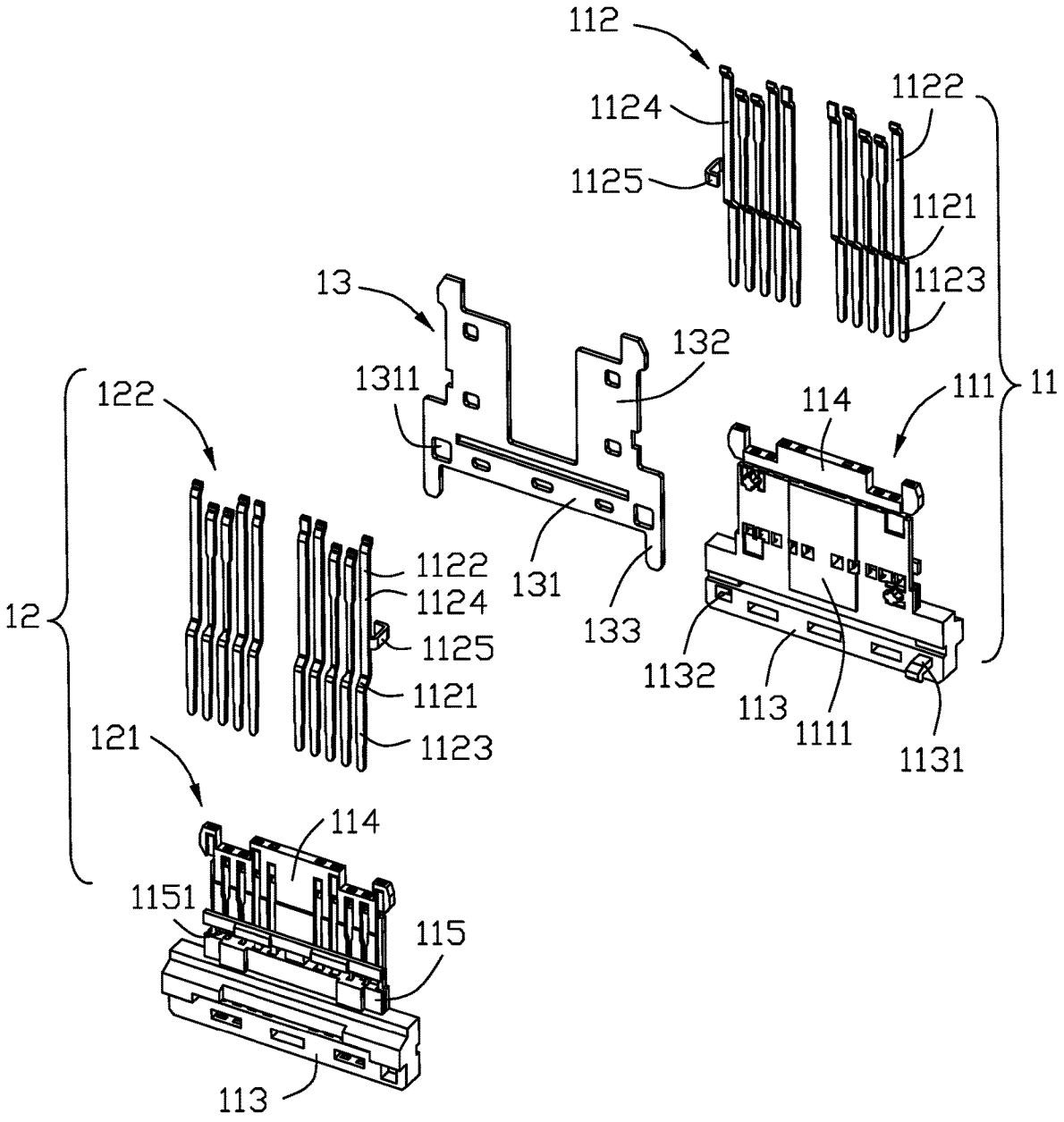
FIG. 12 is a further exploded view of the terminal module in FIG. 10.
Figure 13:
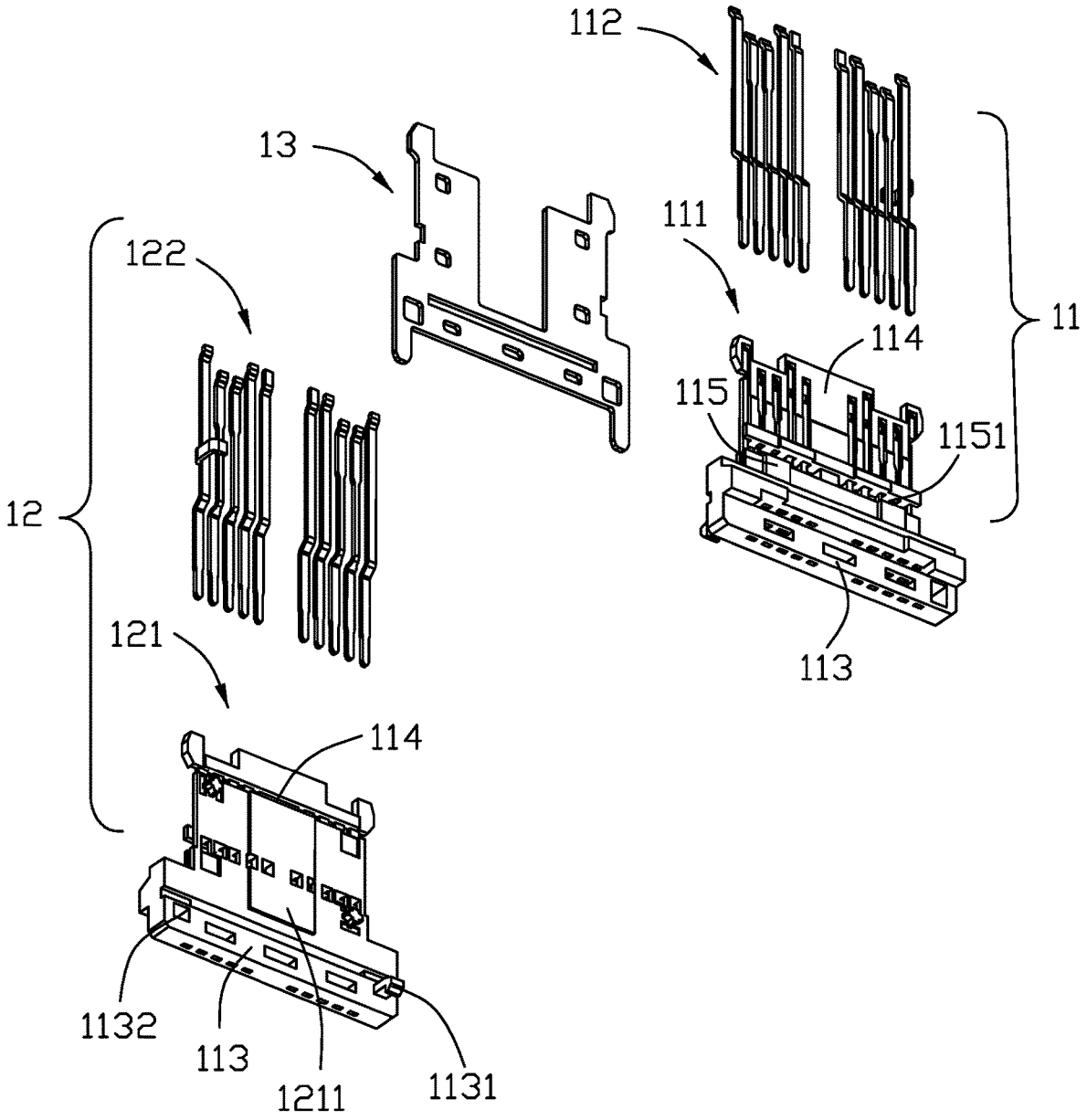
FIG. 13 is a view similar to FIG. 12 but from another perspective.
Figure 14:
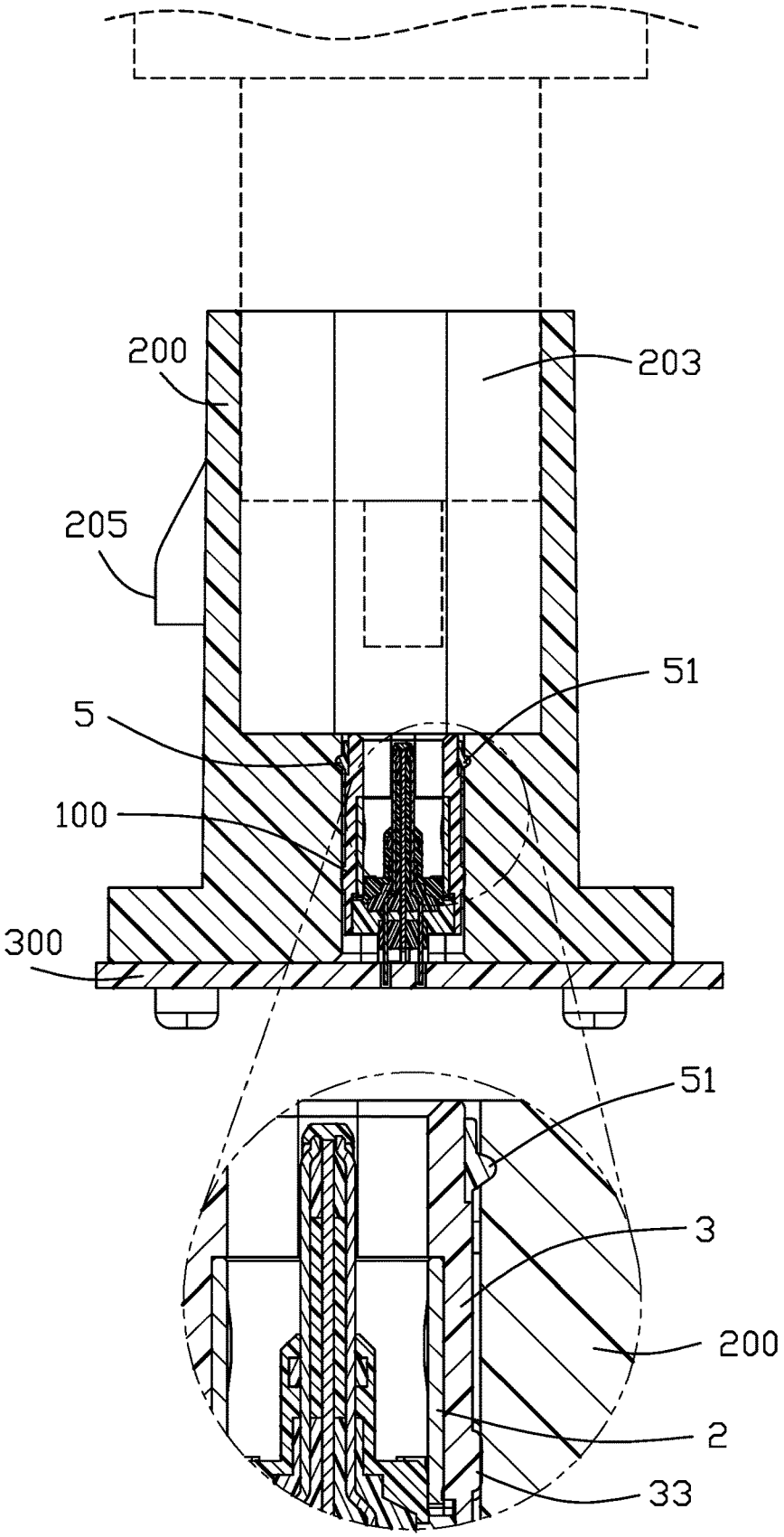
FIG. 14 is a cross-sectional view of the electrical connector assembly taken along line 14-14 in FIG. 1.
Figure 15:
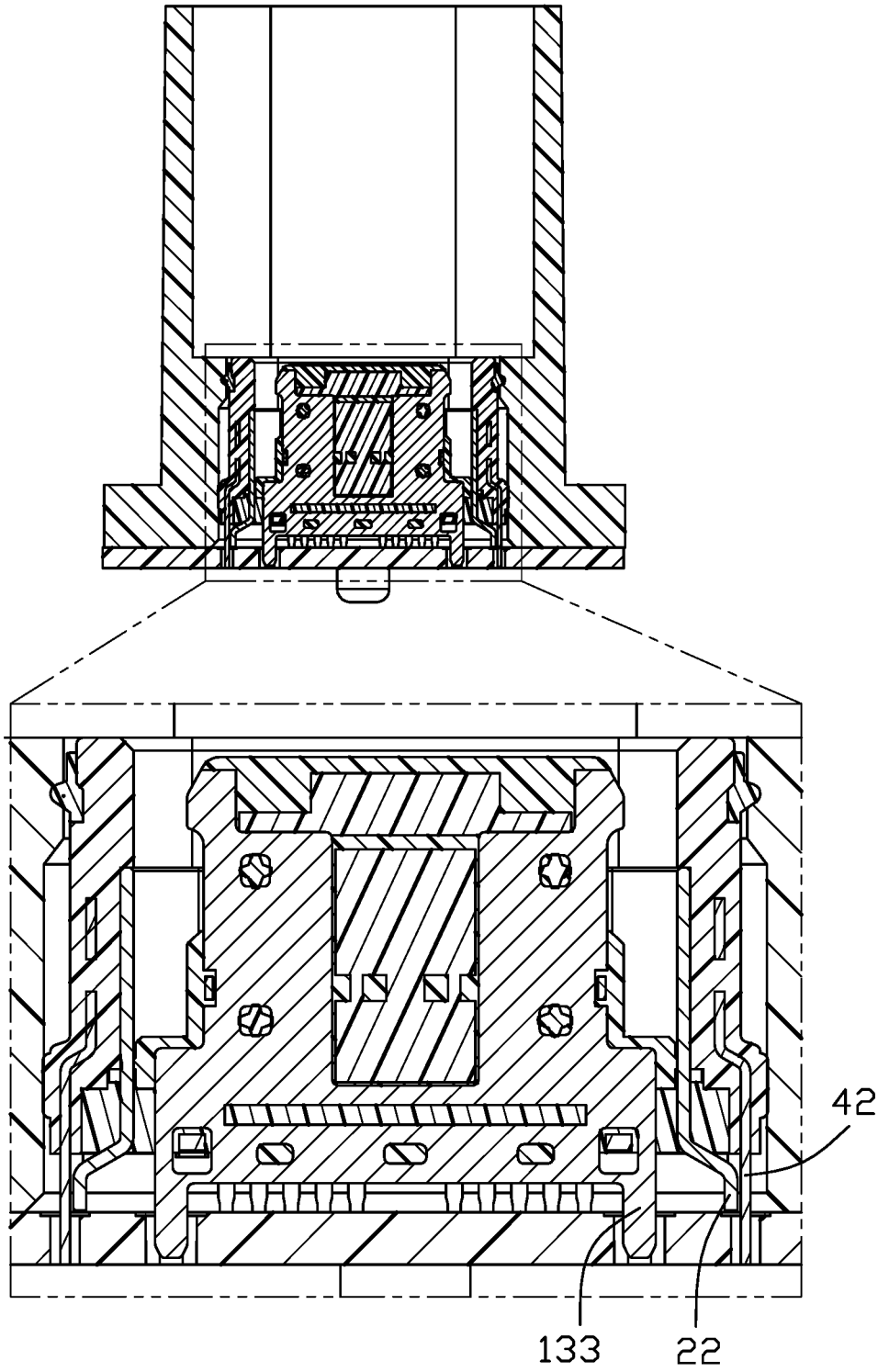
FIG. 15 is another cross-sectional view of the electrical connector assembly taken along line 15-15.

Referring to FIGS. 7-8, the shielding shell 2 has a main body and a pair of side arms 22. The side arms 22 are located beside the bases 113.

The insulative cover 3 has an annular part 31 and a frame part 32 together defining a receiving chamber 30. The insulative cover has a plurality of humps 33 at an outer surface thereof.

The pair of stands 4 are secured to the insulative cover 3 via insert-molding. Each stand 4 has an embedded portion 41 and a fixing arm 42. The front sealing member 5 is disposed in the annular part 31 and has an annular protrusion 51. The insulative cover 3 together with the stands 4 and the sealing member 5 is disposed onto the shielding shell 2 which encloses the terminal module 1, with the side arm 22 bearing against the fixing arm 42. The rear sealing member 6 is applied behind the bases 113 of the terminal module 1 and at an interface between the module 1 and the cover 3. Generally speaking, the shielding shell 2 and the contact module 1 are firstly assembled together as a sub-assembly, and successively assembled into the insulative cover 3. The side arm 22 can be optionally secured to the corresponding fixing arm 42 via welding or soldering so as to have the whole connector 100 is reliably assembled.

Referring to FIGS. 1-4 and 14, the outer housing 200 includes a shroud 202 and an integral flange 201. The flange 201 has plural mounting holes 2011 and a pair of posts 2012. The shroud 202 defines a front receiving space 203 and a rear receiving space 204 of a reduced transverse dimension than the front receiving space.

The electrical connector 100 is accommodated in the rear receiving space 204 and not entering the front receiving space 203. The soldering portions 1123 of the contacts, the soldering legs 133 of the shielding plate 13, and the fixing arms 42 of the stands 4 extend outwardly beyond the sealing member 6 as well as a bottom surface of the flange 201 for reliably soldering to the printed circuit board 300. An inner surface of the outer housing 200 in the rear receiving space 204 may be generally smooth for bearing against by the annular protrusion 51 of the front sealing member 5 or it may be recessed to correspondingly receive the protrusion 51 to effectuate waterproof function. The humps 33 also bear against the inner surface of the rear receiving space 204 but has a height less than the protrusion 51 for balance and stability of the electrical connector 100 with respect to the outer housing 200.

The pair of posts 2012 of the flange 201 are inserted into holes 302 of the PCB 300. The PCB 300 also has holes 301 corresponding to the mounting holes 2011 of the flange 201 for receiving pins, screws, bolts, or the like. The fixing arms 42 of the pair of stands 4 are arranged in a line perpendicular to the line connecting the two posts 2012 so that the electrical connector assembly 1000 is stably mounted to the PCB 300.

The electrical connector assembly 1000 may be used to mate with a mating connector or a connector assembly also equipped with an outer housing. In either case, the outer housing 200 may provide additional protection and structural stability to the mated connectors. When viewed with the PCB 300 being positioned horizontally, the upper/front receiving space 203 is dimensioned larger than the lower/rear receiving space 204 in all the vertical direction, the transverse direction and the longitudinal direction which are perpendicular to one another wherein the longitudinal direction refers to the horizontal extending direction of the shielding plate 13 while the transverse direction refers to the thickness direction of the shielding plate 13. The connector 100 is stably retained in the rear/lower receiving space 204 via the upper/front annular protrusion 51 and the lower/rear humps 33 while the connector 100 and the outer housing 200 are also respectively secured upon the printed circuit board 300. In the connector 100, an upper edge of the shielding shell 2 is much lower than an front edge of the upper/front tongue 114 while an upper edge of the insulative cover 3 is slightly higher than the upper edge of the upper tongue 114. Notably, the insulative cover 3 forms an inner annular recess (not labeled) to receive the shielding shell 2 so as to allow the interior surface of the upper portion of the insulative cover 3 is coplanar with an interior surface of the shielding shell 2 for assuring smooth insertion of the corresponding plug connector. On one hand, the shoulder structure formed by such a recess may function as a stopper to prevent further upward movement of the shielding shell 2 relative to the insulative cover 3. On the other hand, the protrusions 25 of the shielding shell 2 are received within the corresponding recessions 17 of the terminal module 1, so the shielding shell 2 is prohibited from moving downwardly. Notably, the soldering portions 1123 and the soldering legs 133 are secured to the corresponding holes of the PCB 300. One feature of the invention is to provide the outer housing not only protectively receiving the electrical connector therein but also guiding the complementary plug connector (not shown) during the mating process. Understandably, the connector itself is relatively small so as to be easily tilted during the mating process. The relatively large outer housing may assure the correct mating with less tilting during the mating process. This is the reason why in this embodiment the upper receiving space 203 is dimensioned essentially at least two times of the lower receiving space 204 in both the vertical direction and the transverse direction. Notably, as shown in the dashed lines in FIG. 14, in the invention before the complementary plug connector touches the electrical connector 100 which is located in the lower receiving space 204, the rear part of the complementary plug connector assembly may already enter the upper receiving space 203, thus resulting in the efficient corresponding guiding effect during the mating process. In addition, a locking protrusion 205 is formed on an exterior surface of the outer housing 200 and at the same level of the upper receiving space 203 instead of the lower receiving space 204 for efficiently holding the complementary plug connector in mating.

What is claimed is:

1. An electrical connector assembly comprising:

an electrical connector including a terminal module, a shielding shell enclosing the terminal module, an insulative cover enclosing the shielding shell, and a sealing member disposed at a front portion of the insulative cover; and an outer housing accommodating the electrical connector; wherein the insulative cover has a plurality of humps engaging an inner surface of the outer housing; and the sealing member is compressed between the front portion of the insulative cover and the inner surface of the outer housing.

2. The electrical connector assembly as claimed in claim 1, wherein the outer housing includes:

a shroud having a receiving space substantially in front of the electrical connector; and a flange adapted for mounting to a printed circuit board.

3. The electrical connector assembly as claimed in claim 1, wherein the sealing member defines a first transverse dimension of the electrical connector, and the plurality of humps defines a second transverse dimension of the electrical connector which is less than the first transverse dimension.

4. The electrical connector assembly as claimed in claim 1, wherein the terminal module includes a first unit and a second unit of same structure, a shielding plate between the first and second units, and an over-molding insulator molded to the first unit, the second unit, and the shielding plate, each of the first unit and the second unit having an insulative body and a row of contacts, the insulative body including a rear base and a front tongue.

5. An electrical connector assembly comprising:

a horizontally extending printed circuit board;

an insulative outer housing upstanding upon the printed circuit board in a vertical direction, and defining an upper receiving space and a lower receiving space communicating with the upper receiving space in the vertical direction and smaller than the upper receiving space in all the vertical direction, a horizontal longitudinal direction and a horizontal traverse direction perpendicular to one another; an electrical connector received within the lower receiving space, said electrical connector including a terminal module enclosed within a metallic shielding shell and further enclosed within an insulative cover; wherein the terminal module includes contacts with corresponding soldering portions secured to the printed circuit board, a metallic shielding plate with corresponding soldering legs secured to the printed circuit board, and the insulative cover is equipped with fixing arms secured to the printed circuit board; wherein said shielding plate extends along said horizontal longitudinal direction, and a thickness of said shielding plate extends in the transverse direction.

6. The electrical connector assembly as claimed in claim 5, wherein a front edge of the shielding shell is lower than a front edge of a tongue of the terminal module, while a front edge of the insulative outer housing is slightly higher than the front edge of the tongue of the terminal module.

7. The electrical connector assembly as claimed in claim 6, wherein an interior surface of the insulative cover forms a recess to receive the shielding shell therein so as to have an interior surface of the shielding shell coplanar with the interior surface of the insulative cover for smooth insertion of a corresponding plug connector.

8. The electrical connector assembly as claimed in claim 5, wherein the insulative cover is equipped with an upper sealing member and lower humps to snugly received within the lower receiving space.

9. The electrical connector assembly as claimed in claim 5, wherein a dimension of the upper receiving space in the vertical direction is two times of that of the lower receiving space.

10. The electrical connector assembly as claimed in claim 9, wherein a dimension of the upper receiving space in the transverse direction is at least two times of that of the lower receiving space.

11. The electrical connector assembly as claimed in claim 9, wherein the outer housing further includes a locking protrusion on an exterior surface, and said locking protrusion is located at a same level with the upper receiving space.

12. The electrical connector assembly as claimed in claim 5, wherein no portion of the electrical connector extends upwardly into the upper receiving space.

13. An electrical connector assembly comprising:

a horizontally extending printed circuit board;

an insulative outer housing upstanding upon the printed circuit board in a vertical direction, and defining an upper receiving space and a lower receiving space communicating with the upper receiving space in the vertical direction and smaller than the upper receiving space in all the vertical direction, a horizontal longitudinal direction and a horizontal traverse direction perpendicular to one another; an electrical connector received within the lower receiving space, said electrical connector including a terminal module enclosed within a metallic shielding shell; wherein a dimension of the upper receiving space in the vertical direction is more than one and half of that of the lower receiving space.

14. The electrical connector assembly as claimed in claim 13, wherein no part of the electrical connector extends into the upper receiving space.

15. The electrical connector assembly as claimed in claim 13, wherein the outer housing includes a locking protrusion on an exterior surface beside the upper receiving space.

16. The electrical connector assembly as claimed in claim 13, wherein the outer housing is equipped with at least a fixing arm secured to the printed circuit board, and the terminal module has a plurality of contacts with corresponding soldering portions secured to the printed circuit board and a metallic shielding plate with at least a soldering leg secured to the printed circuit board.

17. The electrical connector assembly as claimed in claim 16, wherein the shielding shell includes at least a side arm contacting the fixing arm.

18. The electrical connector assembly as claimed in claim 13, wherein the electrical connector further includes an insulative cover enclosing the shielding shell with humps on the an exterior surface thereof.

19. The electrical connector assembly as claimed in claim 18, wherein said insulative cover is further equipped with an annular sealer upon the exterior surface in front of said humps.

* * * * *